US006073372A

United States Patent [19]

Davis

[11] Patent Number: 6,073,372

[45] Date of Patent: Jun. 13, 2000

[54] METHOD OF ADVERTISING

[76] Inventor: Stephen G. Davis, 1040 W. MacArthur Blvd., #107, Santa Ana, Calif. 92707

[21] Appl. No.: 09/130,410

[22] Filed: Aug. 6, 1998

[51] Int. Cl.[7] ..... G09F 1/00

[52] U.S. Cl. ..... 40/124.16; 40/124.06; 383/121.1

[58] Field of Search ..... 40/124.06, 124.14, 40/124.16, 299.01, 672, 539; 383/121.1, 119, 104; 53/445

[56] References Cited

U.S. PATENT DOCUMENTS 1,886,036 11/1932 Marx ..... 40/539
3,440,747 4/1969 Oliver ..... 40/539
4,444,354 4/1984 Staelgraeve ..... 40/539 X
4,979,547 12/1990 Hoerner ..... 383/119 X
5,028,147 7/1991 Graham ..... 383/119

*Primary Examiner*—Terry Lee Melius
*Assistant Examiner*—James M Hewitt
*Attorney, Agent, or Firm*—Lyon & Lyon LLP

[57] ABSTRACT

A rectangular cardboard insert has small pieces cut from its corners to form a flat base and four edges. The lines forming the intersections of the base with the various edges are scored to help guide the edges as they are folded up. The inserts may be stacked upon one another for easy packaging, shipping, and handling. Ads are placed on the inserts, and the inserts are placed into plastic grocery bags or other carrying containers to reinforce the bottom thereof.

15 Claims, 2 Drawing Sheets

METHOD OF ADVERTISING

FIELD OF THE INVENTION

The present invention relates generally to methods and products for advertising goods and/or services to the general public, or to a targeted group of potential customers.

BACKGROUND OF THE INVENTION

Individuals and large companies spend large amounts of time and money to advertise or market their goods and/or services. The media for advertising vary widely, from old fashioned word-of-mouth, for example, to newspaper and magazine ads, billboards, promotional events and sponsorship thereof, radio and television ads, and more recently ads posted in the on-line world such as on personal web sites or through public on-line billboards. The costs of the various forms of advertising vary greatly, as do their success rates, depending on many factors including demographics of the targeted audience, time, place, and duration of the ads, and many other unknown factors. Since society and the economy are always changing, the marketing/advertising industry is always looking for new ways to reach large amounts of potential customers for relatively little cost.

SUMMARY OF THE INVENTION

Objects of the present invention include providing improved products and methods for advertising. These objects, and others, are accomplished according to an exemplary embodiment of the invention by providing a rigid or semi-rigid insert that can be used to form a reinforced bottom of a bag, such as a plastic grocery bag. The insert may have a pre-printed ad or ads thereon, or other ads attached thereto. Placement of the insert into the bag allows for the ads to be viewed when the bag is substantially empty (e.g., when items in the bag are removed). Additionally, the insert may serve the added purpose of providing a reinforced bottom of the bag so that relatively heavy objects (e.g., cans or bottles) will be less likely to break through the bag. The insert may be manufactured of any suitable material, and may take on various shapes and sizes to accommodate various-sized bags. In a preferred embodiment, the insert is an eight and a half inch by eleven inch (8½×11) or eight and a half inch by twelve inch (8½×12) piece of corrugated cardboard with one inch (1) squares cut out at each corner, such that four edges are formed around a base. The resulting corners are then rounded to help prevent tearing through the bag. The edges are capable of folding up to form a substantially continuous lip around the periphery of the base. The lines forming the intersections of the base with the various edges are preferably scored to help guide the edges as they are folded up. The inserts may be stacked upon one another for easy packaging, shipping, storage, dispensing, and handling.

Other objects and advantages of the present invention will become apparent from the detailed description of the preferred embodiments which follow.

DETAILED DESCRIPTION

Figure 1:
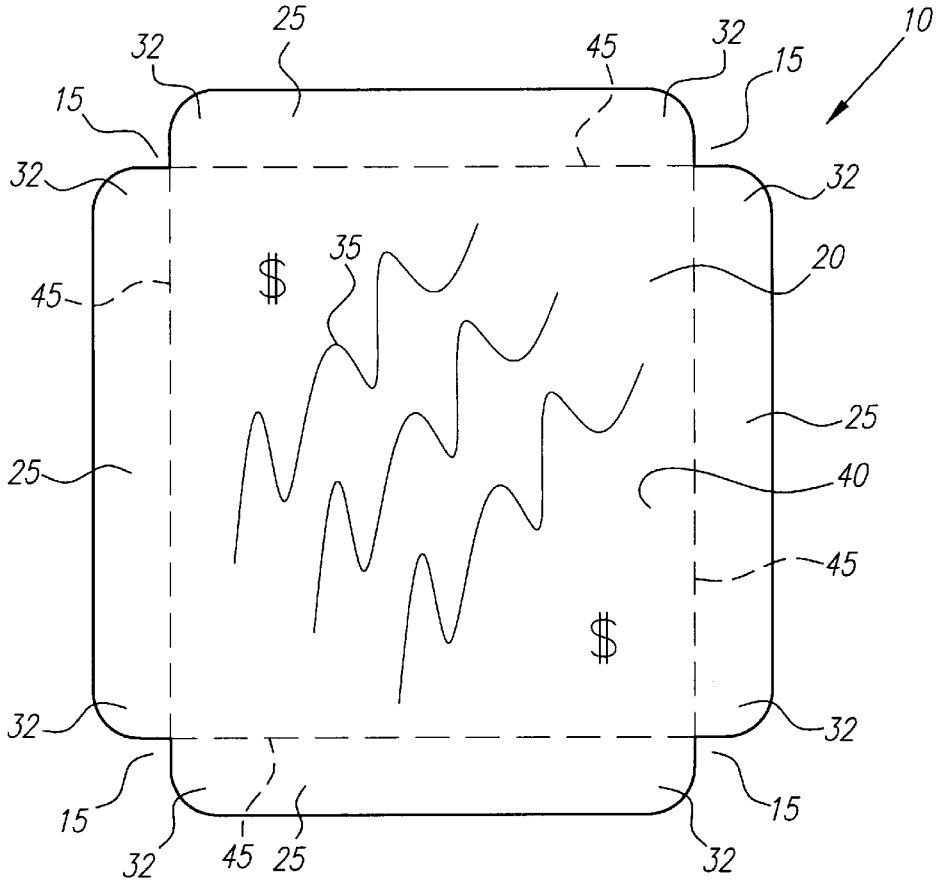
FIG. 1 shows an advertising insert according to the present invention.
Figure 3:
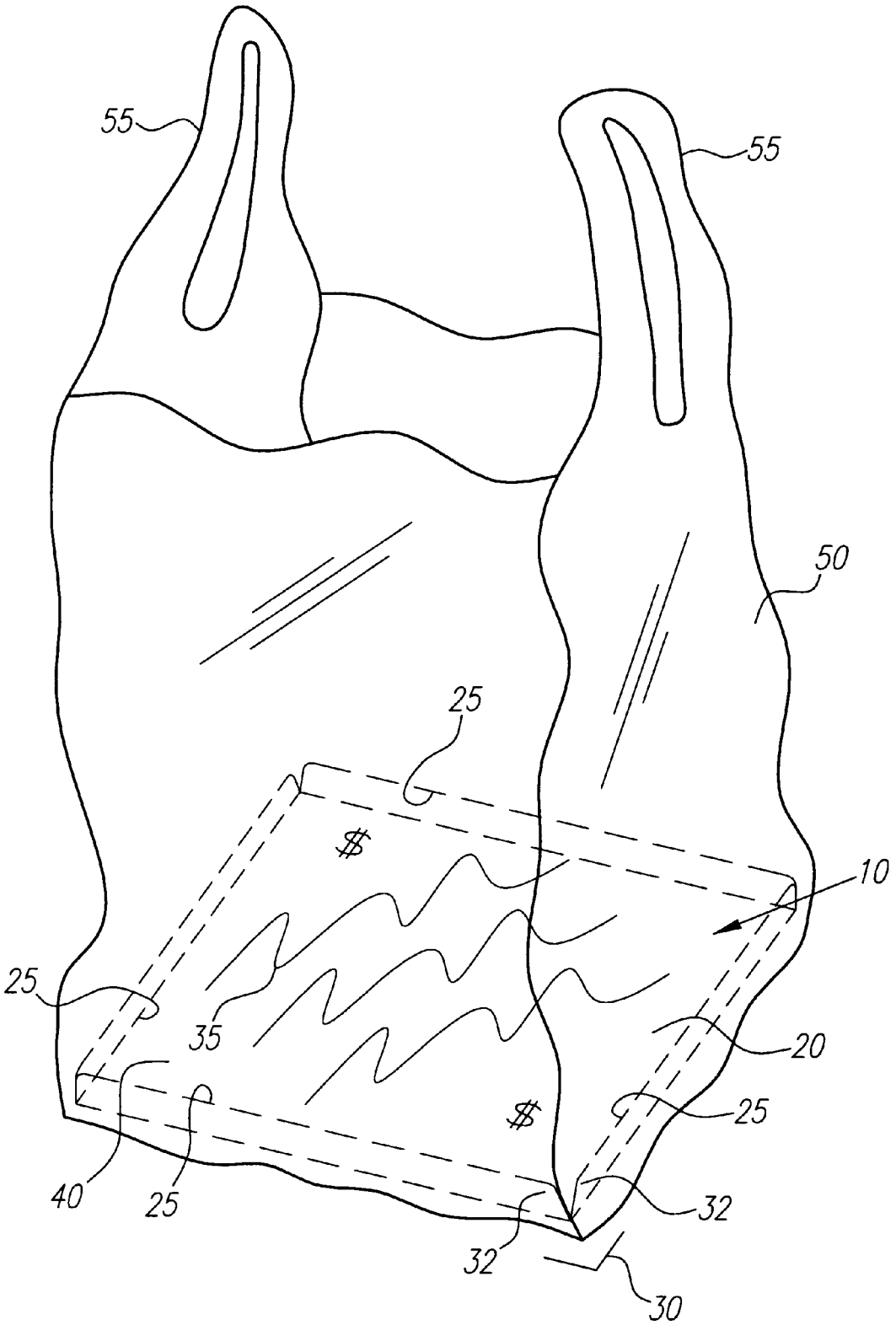
FIG. 3 shows the insert of FIG. 1 used as a reinforcing bottom of a plastic grocery bag.

The present invention relates to methods and products for advertising goods and/or services to the general public, or to a targeted group of potential customers. As seen in FIG. 1, a rigid or semi-rigid insert 10 is preferably substantially rectangular. The insert 10 is at least semi-rigid, but may also be rigid. Preferably there are small pieces cut out at each corner 15, leaving a base 20 and four edges 25. The pieces are preferably squares, so that the edges 25 can be folded up to form a substantially continuous lip 30 around the periphery of the base 20, as seen in FIG. 3. The resulting new corners 32 are then preferably rounded or curved.

The insert 10 has a pre-printed ad 35 on its surface. The ad 35 may be on the upper surface 40 of the base 20, on the opposing lower surface (not shown) of the base 20, on one or more of the edges 25 (upper or lower surface), or any combination thereof. There may be many ads, and they may be pre-printed onto the insert 10 itself, or they may be stickers stuck onto the insert 10, or they may be attached by glue, staples, tape, or any other means.

Figure 2:
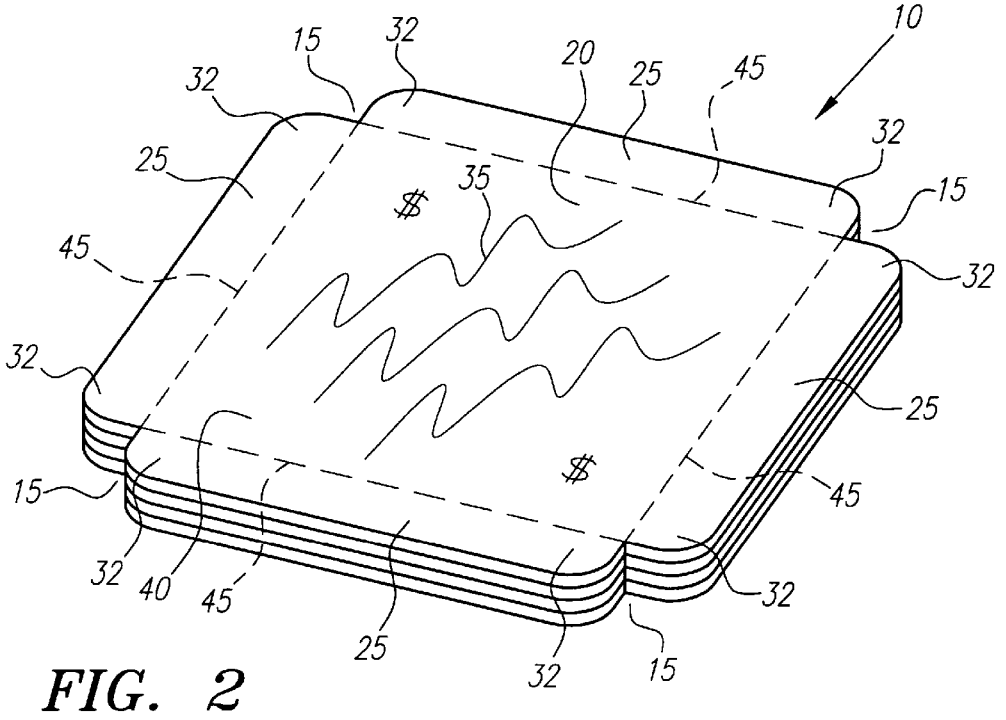
FIG. 2 shows a stack of the inserts seen in FIG. 1.

The insert 10 is preferably made from corrugated cardboard, and is scored along the intersections 45 of the base 20 with the various edges 25. This helps guide the edges 25 as they are folded up as seen in FIG. 3. The scoring may be along only one intersection 45, or along any number and any combination of intersections 45 less than all of them. The inserts 10 may be stacked upon one another for easy packaging, shipping, storage, dispensing, and handling, as seen in FIG. 2. The inserts 10 may be made from other suitable materials such as plastic, foam, rubber, etc., but cardboard is preferred because it is inexpensive and it is relatively simple to print on cardboard or to mount a printed ad on cardboard.

As is known in the art, corrugated board (flute) is available in A to F grades with A being the heaviest. The insert 10 of the present invention is preferably formed using E-flute board as a substrate, with 70# book weight stock mounted or glued (typically by machine) onto the E-flute on either or both faces of the E-flute substrate. The 70# stock is preferably white to facilitate printing, and is also printed on prior to being mounted onto the substrate. The faces are then preferably laminated, and the final piece is then die-cut to form the insert 10. E-flute is used because standard industry machinery that performs the gluing has trouble with the heavier boards (i.e. A–D grade).

A preferred use of the ad inserts 10 is to have them stacked at the end of grocery counters where customers can easily see the ads 35 while they are waiting in the checkout lines or passing thereby. As grocery checkout clerks or baggers are bagging the customers' groceries, the baggers would place an insert 10 into a grocery bag 50 such that the insert 10 rests at or near the bottom of the bag 50, thus reinforcing the bottom of the bag 50. Relatively heavy objects such as cans, bottles, and produce would then be less likely to tear through the paper or plastic of the bag 50. As groceries are placed into the bag 50, they naturally exert a downward force on the base 20. When a bag 50 of groceries is lifted (e.g., by its handles 55), the downward force on the base 20, along with inwardly exerted forces on each of the edges 25 of the insert 10 by the inner surface of the bag 50, urges the edges 25 upward in response thereto as seen in FIG. 3. This provides additional support for the groceries. The amount of force sufficient to cause the edges 25 to bend inward is minimal, e.g., placing as little as one pound of groceries or less inside the bag 50 should be sufficient. This is especially the case when the intersections 45 between the base 20 and the edges 25 are scored. As previously stated, the scoring is not necessary, and less than all of the intersections 45 may be scored. For example, the insert 10 may be shaped to fit a carrying container such that only opposing edges 25 of the insert 10 bend inwards when placed in a carrying container, while the remaining edges rest comfortably at the bottom of the container without bending inward or upward. The corners 32 may be rounded or curved as previously stated, to lessen the likelihood that they would tear or poke through the bag 50. When customers unpack their groceries, they again would be exposed to the advertisements 35 on the inserts 10.

The inserts 10 may even become collectible items for trade and/or display. For example, a particular company may produce a special series of Olympic inserts, holiday inserts, sporting figure inserts, etc. In addition, there can be contests and prizes, such as a marketing program where any customer that received an insert or group of inserts having a particular predetermined number, color, pattern, etc., would receive prizes or other benefits. All of these concepts would increase the likelihood of customers paying closer attention to the ads, thereby giving advertisers a better chance to get their message to the customers. Advertisers could also design specific ads 35 to be placed on inserts 10 for a targeted demographic population, based on geographic location, supermarket chain, type of retailer, etc. There may also be demographic or marketing surveys printed on or attached to the inserts, with associated benefits such as coupons or rebates for customers who participate in the survey. This would allow the advertisers to gather valuable marketing information at a minimal cost.

Thus, advertisers could reach a large segment of the population for a relatively low cost, and at the same time potential customers of the advertisers would receive the benefit of having a sturdy base for their grocery bag 50.

Certain embodiments have been described herein, and are illustrated in the drawings. However, it will be apparent to those skilled in the art that modifications can be made to the embodiments without departing from the inventive concepts described. For example, the products and methods described herein are applicable to retailers, distributors, etc., other than grocery stores, and are applicable for use with a wide variety of bags and other carrying containers that have non-rigid or non-semi-rigid bottoms. In addition, the inserts 10 have been shown and described as being generally two-dimensional or substantially flat. However, they may also have edges 25 that are preformed to curve upward and form the lip 30, such that the insert 10 has the general shape of a tray or saucer. Accordingly, the invention is not to be restricted except by the claims which follow.

What is claimed is:

1. A method of advertising comprising the steps of:

providing an ad on a semi-rigid insert;

placing the insert into a carrying container;

positioning the insert to rest near a bottom of the carrying container such that the ad may be viewed when the carrying container is substantially empty; and distributing the carrying container with the insert therein to a customer, the insert being removable from the carrying container by the customers, wherein the insert is substantially rectangular with small pieces removed from each corner, thereby defining a plurality of edges extending from a central base, the edges folding inward when a product is placed in the carrying container onto the insert, the edges having nonoverlapping corners with adjacent edges when folded inward.

2. The method of claim 1 wherein the insert is made from corrugated cardboard.

3. The method of claim 2 wherein the insert is scored along at least one intersection between the plurality of edges and the central base.

4. The method of claim 1 wherein the carrying container is a bag.

5. The method of claim 4 wherein the bag is a grocery bag, and further comprising the step of placing groceries into the bag.

6. The method of claim 5 wherein the grocery bag is a plastic bag.

7. A method of advertising comprising the steps of:

providing a stack comprising a plurality of advertising inserts on top of each other, the inserts being at least semi-rigid and having an advertisement on at least one surface thereof, each insert comprising corrugated cardboard having scored areas that separate a base portion from edges of the insert;

removing a first insert from the stack;

placing the first insert into a plastic bag such that the advertisement may be viewed when the bag is substantially empty, the insert being removably inserted into the bag; and placing a grocery item into the bag on top of the first insert, wherein the first insert is placed into the bag such that after the grocery item is placed on top of the insert and the bag is lifted up, the edges of the insert urge inward to define nonoverlapping corners between adjacent edges.

8. An advertising insert comprising:

a base that is at least semi-rigid, the base having an outer periphery and a surface having an advertisement thereon; and a plurality of edge regions disposed around the outer periphery of the base and defining intersections therewith;

the edge regions being capable of folding inward along the respective intersections when the insert is placed inside a bag having an unsupported bottom, the edge regions having nonoverlapping corners with adjacent edge regions when folded inward.

9. The advertising insert of claim 8, wherein the insert is made of corrugated cardboard.

10. The advertising insert of claim 9 wherein the advertisement comprises a sticker attached to the surface of the base of the insert.

11. The advertising insert of claim 9 wherein the insert serves as a rigidifying member for the bottom of a bag into which it is placed for supporting items placed inside the bag.

12. The advertising insert of claim 9 wherein the insert is substantially rectangular with rectangular pieces cut out at each corner to form new corners, and wherein the base is rectangular.

13. The advertising insert of claim 12 wherein the new corners are curved.

14. A container, comprising:

a carrying container having a non-rigid bottom and an open top; and a generally rectangular insert formed from at least semi-rigid material, the insert having a surface including one or more advertisements thereon, the insert being removably inserted into the carrying container across the bottom thereof, the one or more advertisements being viewable from the open top when the carrying container is substantially empty, wherein the insert has pieces removed from its corners, thereby defining foldable edges extending from the insert, the edges defining nonoverlapping corners between adjacent edges when folded inward.

15. The container of claim 14, wherein the edges have rounded corners.

* * * * *